US010319286B2

(12) United States Patent
Do et al.

(10) Patent No.: US 10,319,286 B2
(45) Date of Patent: Jun. 11, 2019

(54) DISPLAY DEVICE

(71) Applicant: LG Display Co., Ltd., Seoul (KR)

(72) Inventors: Osung Do, Paju-si (KR); Juyoung Noh, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/783,847

(22) Filed: Oct. 13, 2017

(65) Prior Publication Data

US 2018/0122294 A1 May 3, 2018

(30) Foreign Application Priority Data

Oct. 31, 2016 (KR) ..... 10-2016-0142751

(51) Int. Cl.
*G09G 5/00* (2006.01)
*G09G 3/20* (2006.01)
(Continued)

(52) U.S. Cl.
CPC ..... *G09G 3/2096* (2013.01); *G09G 3/3225* (2013.01); *G09G 5/008* (2013.01);
(Continued)

(58) Field of Classification Search
CPC .... G09G 3/2096; G09G 5/008; G09G 3/3225; G09G 2370/08; G09G 2370/10; G09G 3/3266; G09G 2310/08; G09G 2320/043; G09G 3/3275; G09G 2320/0233; G09G 2320/045; G09G 2330/02
See application file for complete search history.

(56) References Cited

U.S. PATENT DOCUMENTS

2011/0181558 A1* 7/2011 Jeon ..... G09G 3/3611 345/204
2014/0118235 A1* 5/2014 Hong ..... G09G 5/008 345/87

(Continued)

FOREIGN PATENT DOCUMENTS

EP 3038086 A2 6/2016
KR 10-2016-0053116 A 5/2016

OTHER PUBLICATIONS

European Extended Search Report, European Application No. 17199460.1, dated Feb. 2, 2018, 13 pages.

*Primary Examiner* — Jonathan A Boyd
(74) *Attorney, Agent, or Firm* — Fenwick & West LLP

(57) ABSTRACT

The display device according to an embodiment of the present disclosure comprises a display panel; a source drive IC configured to provide data voltages to the pixels, convert signals indicating driving characteristics of the pixels into sensing data and output the sensing data; and a timing controller configured to transmit a control data packet and a video data packet to the source drive IC through first and second wire pairs and receive the sensing data from the source drive IC through the second wire pair, wherein the timing controller is configured to load lock information indicating whether a clock extracted from a signal provided from the source drive IC through the second wire pair is locked or not into the control data packet and provide the control data packet to the source drive IC through the first wire pair, when receiving data from the source drive IC.

10 Claims, 8 Drawing Sheets

(51) Int. Cl.

| | |
|---|---|
| ***G09G 3/3225*** | (2016.01) |
| *G09G 3/3266* | (2016.01) |
| *G09G 3/3275* | (2016.01) |

(52) U.S. Cl.

CPC ..... *G09G 3/3266* (2013.01); *G09G 3/3275* (2013.01); *G09G 2310/08* (2013.01); *G09G 2320/0233* (2013.01); *G09G 2320/043* (2013.01); *G09G 2320/045* (2013.01); *G09G 2330/02* (2013.01); *G09G 2370/08* (2013.01); *G09G 2370/10* (2013.01)

(56) References Cited

U.S. PATENT DOCUMENTS

| | | | | |
|---|---|---|---|---|
| 2016/0125840 | A1* | 5/2016 | Oh, II | G09G 5/006 345/213 |
| 2017/0178562 | A1* | 6/2017 | Hekmat | G09G 3/2096 |

* cited by examiner

DISPLAY DEVICE

CROSS-REFERENCE TO RELATED APPLICATIONS

This application claims the benefit of priority under 35 U.S.C. § 119(a) of Republic of Korea Patent Application No. 10-2016-0142751 filed on Oct. 31, 2016, which is incorporated by reference herein in its entirety.

BACKGROUND

Field of Technology

The present disclosure relates to an interface structure for exchanging data between a controller and a panel in a display device.

Discussion of the Related Art

An active matrix type organic light emitting display covers an organic light emitting diode (hereinafter, referred to as "OLED") which emits light by itself, and has advantages of a fast response speed, high light emitting efficiency, high brightness, and a wide viewing angle.

An organic light emitting display device arranges pixels each including an OLED and a driving TFT (Thin Film Transistor) in a matrix form, and adjusts the luminance of an image implemented in a pixel according to gradation of video data. The driving TFT controls the driving current flowing in the OLED according to the voltage applied between the gate electrode and the source electrode of the driving TFT. The emission amount of the OLED is determined according to the driving current, and the brightness of the image is determined according to the emission amount of the OLED.

When the driving TFT operates in the saturation region, the pixel current flowing from the drain to the source of the driving TFT changes depending on the electrical characteristics of the driving TFT, such as a threshold voltage and an electron mobility. The electrical characteristics of the driving TFTs vary between pixels due to various causes such as process conditions, driving environments and time-varying characteristics, and thus even if a same data voltage is applied to pixels having different electrical characteristics of TFTs, luminance deviations occur between the pixels. So, unless the characteristic deviations are compensated, it is difficult to realize desired quality for image.

In order to solve this problem, there has been proposed a technique of compensating for a luminance deviation due to a deviation of electrical characteristics (threshold voltage, mobility) of driving TFTs within pixels and/or outside pixels. An external compensation method senses the characteristic parameters of the driving TFTs of individual pixels and precisely corrects input data according to the sensing values, but has a disadvantage that it takes a long time for sensing. On the other hand, an internal compensation method can compensate for the luminance deviation in real-time but has a disadvantage that a pixel structure is complicated and an aperture ratio is low.

In the external compensation method, a source drive IC for display pixels of a display panel senses a current or a voltage flowing in a sensing line connected to the pixels and outputs the sensed current or voltage to an analog-to-digital converter (ADC) which converts it into digital sensing data and transmits the digital sensing data to a timing controller, and the timing controller modulates the digital video data of input image based on the sensing results of the pixels and supplies the modulated digital video data to the source drive IC to compensate for the change in driving characteristics of the pixels.

Still, the interface through which the timing controller provides video data for display to the source drive IC and the interface through which the source drive IC provides the digital sensing data to the timing controller exist separately. Particularly, the interface for transmitting the digital sensing data is driven in a multi-drop manner, and a clock wiring pair is required separately from a signal wiring pair, so there are problems that the number of pads of the source drive IC is large and a transfer speed is slow.

SUMMARY

The present disclosure has been made in view of the above circumstances. It is an object of the present disclosure to provide a display device which connects a panel and a timing controller with a simple interface.

It is another object of the present disclosure to provide a display device that implements an interface for transmitting video data to be bidirectional without using an interface for transmitting panel characteristic data.

It is yet another object of the present disclosure to provide a display device that improves data transmission speed from a panel to a timing controller.

A display device according to an embodiment of the present disclosure comprises: a display panel equipped with a plurality of pixels; a source drive IC configured to provide data voltages to the pixels, convert signals indicating driving characteristics of the pixels into sensing data and output the sensing data; and a timing controller configured to transmit a control data packet and a video data packet to the source drive IC through first and second wire pairs and receive the sensing data from the source drive IC through the second wire pair, wherein the timing controller is configured to load lock information indicating whether a clock extracted from a signal provided from the source drive IC through the second wire pair is locked or not into the control data packet and provide the control data packet to the source drive IC through the first wire pair, when receiving data from the source drive IC.

In an embodiment, the timing controller may be configured to transmit, through the first wire pair or the second wire pair, data related to a sensing command indicating to sense the driving characteristics, and receive the sensing data through the second wire pair.

In an embodiment, the source drive IC may be configured to sense the driving characteristics during a power-on sequence, a power-off sequence or a vertical blank period, and transmit the sensing data to the timing controller through the second wire pair.

In an embodiment, the timing controller may be configured to operate the second wire pair only in a reception mode or switch an operation mode of the second wire pair between a transmission mode and the reception mode during a power-on sequence, a power-off sequence or a vertical blank period.

In an embodiment, the data related to the sensing command may include pixel line information for sensing the driving characteristics, pixel color information for sensing the driving characteristics and data for sensing to drive a corresponding pixel color.

In an embodiment, the timing controller may comprise: a first transmission unit for sending the control data packet, the video data packet and signals including a clock to the source drive IC; a first receiving unit for receiving the signal from the source drive IC through the second wire pair at a time of a sensing driving of sensing the driving characteristics; a first switch pair for selectively connecting the second wire pair to one of the first transmission unit and the first receiving unit according to mode information indicating a communication direction of the second wire pair; a first serializer for generating the mode information and generating the video data packet including video data of input image and the control data packet including the mode information and the lock information; and a first de-serializer for recovering the clock from the signal received by the first receiving unit, generating the lock information indicating whether the clock is locked or not, sending the lock information to the first serializer and recovering the sensing data, at the time of the sensing driving.

In an embodiment, the source drive IC may comprises: a second receiving unit for receiving a signal through the first and the second wire pairs; a second transmission unit for sending a signal including sensing data packet and a clock through the second wire pair at the time of the sensing driving; a second switch pair for selectively connecting the second wire pair to one of the second receiving unit and the second transmission unit according to the mode information; a second de-serializer for recovering a clock from the signal received by the second receiving unit, separating control data and video data based on the recovered clock, and extracting the mode information and the lock information from the control data; and a second serializer for encoding received sensing data into the sensing data packet to output to the second transmission unit at the time of the sensing driving, wherein the second transmission unit may transmit a signal including the clock and then transmit a signal including the sensing data packet according to the lock information.

In an embodiment, the second de-serializer may generate a first lock signal and a second lock signal and generate a third lock signal based on the first and second lock signals at a time of a display driving for displaying the input image on the display panel, and generate the third lock signal based on the first lock signal and the mode information at the time of the sensing driving, the first lock signal indicating whether a clock extracted from the signal received by the second receiving unit through the first wire pair is locked or not and the second lock signal indicating whether a clock extracted from the signal received by the second receiving unit through the second wire pair is locked or not, and wherein the third lock signal may be provided to the timing controller through a lock signal line.

In an embodiment, the second de-serializer may generate the third lock signal by performing an AND logic operation of the first lock signal and a result value obtained by an OR logic operation of the second lock signal and the mode information.

In an embodiment, the second transmission unit may transmit the sensing data packet which is generated by the second de-serializer and includes sensing end information indicating an end of the sensing driving through the second wire pair, the first de-serializer may extract the sensing end information from the sensing data packet and output the extracted sensing end information to the first serializer, and the first serializer may change a value of the mode information bases on the sensing end information.

Therefore, by removing the interface for transferring the sensing data for panel driving characteristics, the number of pads of the source drive IC is reduced, and the connection structure between the timing controller and the source drive IC is simplified.

Further, the transmission speed of the sensing data for the panel driving characteristics is improved, thereby reducing the time required to sense the panel driving characteristics, and sensing the driving characteristics of more pixels in real time.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
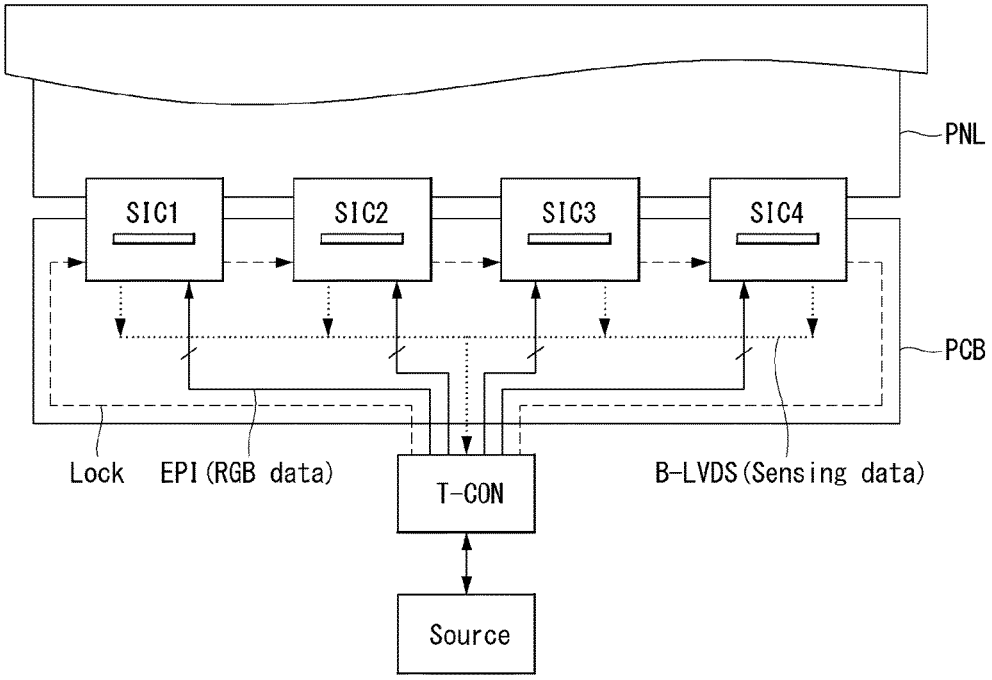
FIGS. 1 and 2 illustrate conventional wiring connections between a timing controller and a source drive IC.

Hereinafter, embodiments of the present disclosure will be described in detail with reference to the accompanying drawings. Same reference numerals throughout the specification denote substantially identical components. In the following description, a detailed description of known functions and configurations incorporated herein will be omitted when it may make the subject matter of the present disclosure rather unclear.

A general display device includes a timing controller, a data driving circuit, a gate driving circuit, and a panel. The timing controller receives video data and a timing signal from a source, processes the data, and provides the processed data to the data driving circuit and the gate driving circuit as video signals and control signals. The data driving circuit and the gate driving circuit are connected directly to the pixels included in the panel through data lines and gate lines to display image through the pixels.

The source and the timing controller are connected through wiring lines according to a system interface such as Vx1. The timing controller and the data driving circuit are connected through a wiring line pair according to a panel internal interface such as an EPI (Embedded Clock P-P Interface). The timing controller and the gate driving circuit are connected by a predetermined number of lines, and the data driving circuit and the gate driving circuit are physically directly connected to the panel by a number of lines corresponding to the resolution of the panel.

Figure 2:
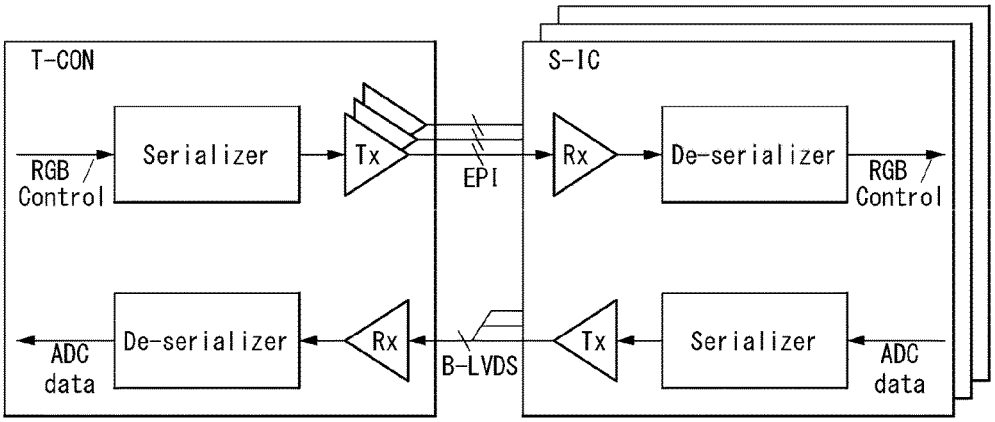

FIGS. 1 and 2 illustrate conventional wiring connections between a timing controller and a source drive IC.

The display device in FIG. 1 includes a panel PNL, a timing controller T-CON, source drive ICs SIC1, SIC2, SIC3, and SIC4, and a source, and a gate driving circuit (or scan driving circuit) is omitted. In FIG. 1, T-CON denotes a timing controller, and SIC1 to SIC4 denote four source drive ICs included in a data driving circuit, but the number of source drive ICs is one or more but not limited to four.

The source drive IC receives a clock signal, a control signal CTR, and pixel data (or video data) (RGB data) of input image from the timing controller T-CON through an intra-panel interface such as an EPI. The timing controller T-CON and each source drive IC are connected in a 1:1 form, i.e., point-to-point form, via an EPI wiring pair EPI. The source drive IC restores a clock from the signal provided by the timing controller T-CON, fixes the phase and frequency of an internal clock, and outputs a lock signal. The timing controller T-CON transfers the data packet including control data and video data to the source drive IC after the lock signal is received from the last source drive IC.

And, the source drive IC transfers the digital sensing data for operation characteristics of the panel to the timing controller T-CON through a panel internal interface such as a B-LVDS (Bus Low Voltage Differential Signaling) interface. The B-LVDS interface is connected in a multi-drop manner and includes a pair of data wiring and a pair of clock wiring.

In FIG. 2, the timing controller T-CON converts the video data RGB and the control data of the input image into serial data and distributes the serial data to a plurality of transmission units Tx. There are as many transfer units Tx as the number of the source drive ICs included in the data driving circuit of the panel. Each transfer unit Tx of the timing controller T-CON is connected to a receiving unit Rx of one source drive IC through an EPI interface to transmit the video data and the control data, and the receiving unit Rx of the source drive IC separates the received data into video data RGB and control data Control (De-serializer) and supplies the video data to the pixels.

The source drive IC converts the driving characteristic sensing data detected through the sensing lines connected to the pixels into digital sensing data (ADC data) through an analog-to-digital converter ADC, converts them into serial data (Serializer) and transmits the serial data to transmission unit Tx. The transmission units Tx included in the plurality of source drive ICs transfer the digital sensing data to the receiving unit Rx of the timing controller T-CON via the B-LVDS interface. The timing controller T-CON may separate (De-serializer) and store it temporarily in a memory (not shown), and use it to generate compensation data used to compensate the driving characteristics.

As shown in FIGS. 1 and 2, the timing controller and the source drive IC employ separate interfaces. That is, the EPI interface and the B-LVDS interface, for exchanging video data for screen driving and sensing data. Further, the B-LVDS interface includes a pair of signal wires and a pair of clock wires, so that the number of pads in the source drive IC is large. The actual data transfer rate of the B-LVDS interface is 10 MHz (maximum 200 MHz), much lower than the actual data transfer rate of EPI interface 780 MHz (max. 1.5 GHz).

Therefore, there is a problem in that the number of pixel lines that can be sensed in one period (for example, a blank interval) is limited when the real-time sensing of the pixel driving characteristic is performed because there is a time limit for transmitting the sensing data.

On the other hand, since the resolution of the display panel has increased recently and one pixel is formed into a RGBW subpixel structure instead of a RGB subpixel structure, the amount of video data to be transmitted to the data driving circuit in one limited horizontal period is increased. In order to cope with such an increased amount of data, the number of source drive ICs can be increased. However, an EPI wiring pair, a lock signal line, a pair of lines for sensing data transmission, a pair of clock lines for sensing clock, etc. are connected to each source drive IC, so there is a problem that the data driving circuit becomes large and complicated.

Thus, instead of increasing the number of source drive ICs, a method of connecting a timing controller and a source drive IC through an EPI interface of two wiring pairs is employed. Since the method requires only the addition of another EPI wiring pair, the size of the data driving circuit need not be increased.

In a display device including a timing controller and a source drive IC connected by two EPI wiring pairs, the present disclosure does not require B-LVDS interface lines for sensing data transfer and enables one EPI wiring pair (e.g., EPI2) out of the two EPI wiring pairs (EPI1, EPI2) to be bi-directional communicable, such that the two EPI wiring pairs are used for transmitting video data at a display driving for displaying video data, and one EPI wiring pair (EPI2) is used for transmitting sensing data at a sensing driving for sensing the driving characteristics of the panel.

The present disclosure may control the data transfer direction of the EPI2 that performs bidirectional communication using control data transmitted through the EPI1 and provide information required for the operation of the transfer mode to transfer data from the source drive IC to the timing controller via EPI2, for example, information indicating the completion of the communication link to the source drive IC from the timing controller via EPI1.

Figure 3:
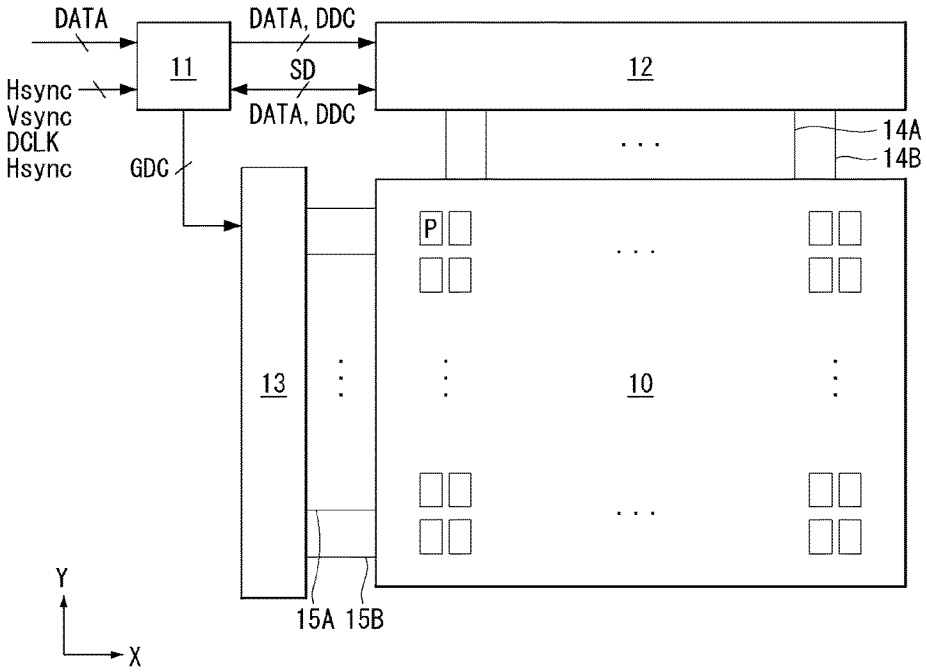
FIG. 3 is a block diagram showing a driving circuit of a display device according to an embodiment of the present disclosure.
Figure 4:
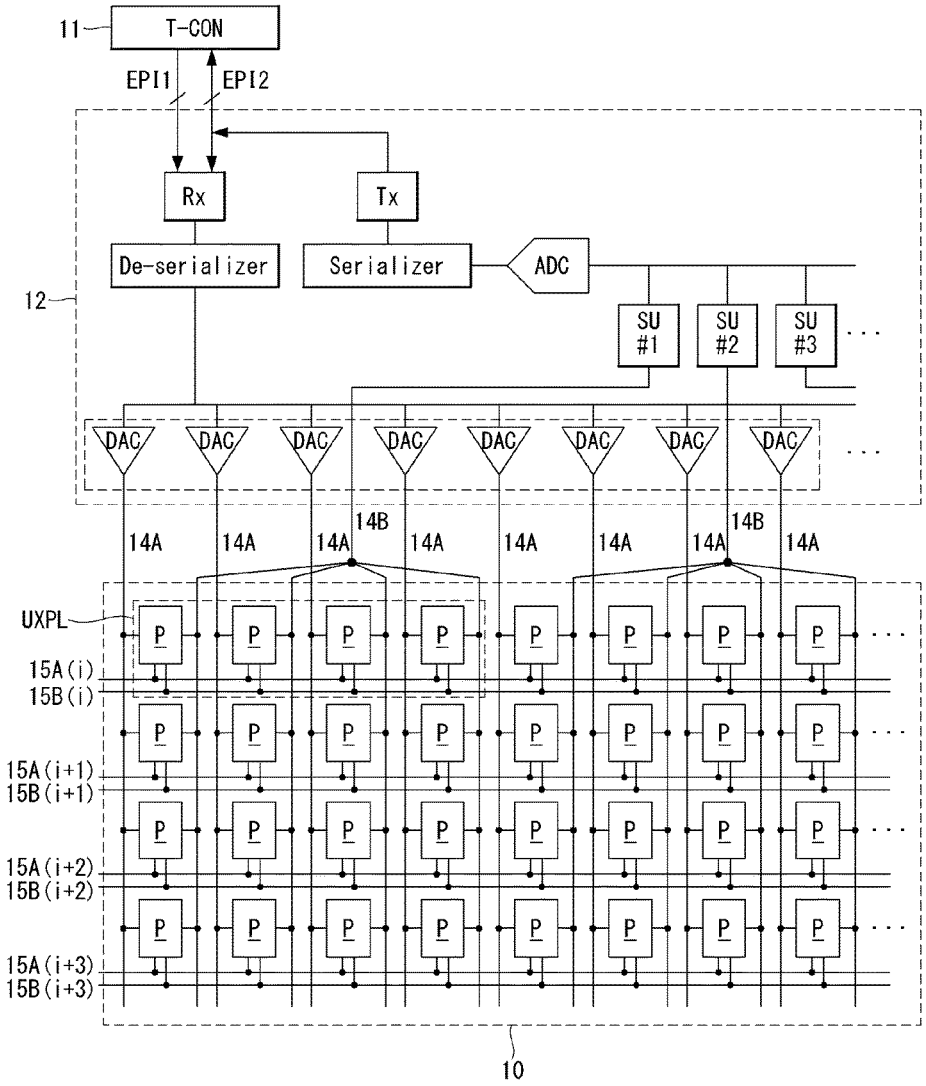
FIG. 4 shows a configuration of a pixel array and a source drive IC for detecting driving characteristics of pixels, according to an embodiment of the present disclosure.

FIG. 3 is a block diagram showing a driving circuit of a display device according to an embodiment of the present disclosure, and FIG. 4 shows a configuration of a pixel array and a source drive IC for detecting driving characteristics of pixels.

The display device according to the present disclosure may comprise a display panel 10, a timing controller 11, a data driving circuit 12 and a gate driving circuit 13.

A plurality of data lines 14A and sensing lines 14B and a plurality of gate lines (or scan lines) 15A and 15B cross each other on the display panel 10, and the pixels P are arranged in a matrix form to constitute a pixel array. The plurality of gate lines may include a plurality of first gate lines 15A to which a first scan signal SCAN is supplied and a plurality of second gate lines 15B to which a second scan signal SEN is supplied. The touch sensors for implementing touch user interface UI may be built in the pixel array.

Each pixel P is connected to any one of the data lines 14A, any one of the sensing lines 14B, any one of the first gate lines 15A, and any one of the second gate lines 15B. Each pixel P is supplied with a high potential drive voltage and a low potential drive voltage from a power supply not shown.

For example, the pixel P of the organic emitting display panel 10 is supplied with the high potential drive voltage EVDD and the low potential drive voltage EVSS from a not-shown power supply, and may comprise an OLED, a driving TFT, a storage capacitor, a firstswitch TFT, and a second switch TFT. The TFTs constituting the pixel P may be implemented as a p-type or an n-type or as a hybrid type in which P-type and N-type are mixed. In addition, the semiconductor layer of the TFTs may include amorphous silicon, polysilicon, or an oxide.

The display device to which a present disclosure is applied may adopt an external compensation scheme. The external compensation scheme senses driving characteristics of one or more pixels or sub-pixels among a plurality of pixels or sub-pixels disposed in a display panel and compensates the digital data of input image according to sensing values. For example, the driving characteristics of the pixels mean a change of a threshold voltage and a change of mobility of a transistor used as a driving element, a change of a threshold voltage of the OLED, and so on.

The timing controller 11 may temporally separate the sensing driving (or external compensation driving) for sensing the driving characteristics of the pixels and updating compensation values according to the sensed characteristics and the display driving for displaying the input image reflecting the compensation values, according to a predetermined control sequence. By the control operation of the timing controller 11, the external compensation driving is performed during vertical blank periods while the display driving is performed, or during a power-on sequence period before the display driving is started (a non-display period until an image display period in which an image is displayed after driving power is applied), or in a power-off sequence period after the display driving is finished (a non-display period until the drive power is turned off immediately after the image display is ended).

The vertical blank period is a period in which input image data is not written, and is arranged between two vertical active periods in each of which input image data for one frame is written. The power-on sequence period refers to a transient period from when the driving power is turned on until the input image is displayed. The power-off sequence period means a transient period from the end of the display of the input image until the driving power is turned off.

The external compensation driving for sensing and compensating the driving TFT characteristics may be performed in a state where only the screen of the display device is turned off during the system power supply, for example, in a standby mode, a sleep mode, a low power mode, and the like. The timing controller 11 detects a standby mode, a sleep mode, a low power mode, and the like according to a predetermined sensing process, and controls all operations for the external compensation driving.

The OLED display device will be mainly described as a display device to which the present disclosure is applied, but the display device of the present disclosure is not limited thereto. For example, the display device of the present disclosure can be applied to any display device, for example, a liquid crystal display LCD or an inorganic light emitting display device using an inorganic substance as a light emitting layer, which needs to sense driving characteristics of pixels in order to increase the reliability and life of the display device.

Hereinafter, the pixel driving characteristics of which are sensed refer to at least one of a normal pixel in which the pixel data of input image is written and which is disposed in a display area, and a dummy pixel disposed outside the display area. The pixels may include red R, green G, and blue B sub-pixels for color implementation. The pixels may further include a white sub-pixel. The pixels may further include or alternatively include one or more of cyan, magenta, yellow sub-pixels. The dummy pixel may be placed on the display panel for the purpose of indirectly sensing a change in the driving characteristics of the normal pixel and may be made in the same or similar structure as the normal pixels.

The timing controller 11 generates the data control signal DDC for controlling the operation timings of the data driving circuit 12 and the gate control signal GDC for controlling the operation timings of the gate driving circuit 13, based on timing signals, such as a vertical synchronization signal Vsync, a horizontal synchronization signal Hsync, a dot clock signal DCLK, and a data enable signal DE. In addition, the timing controller 11 may temporally separate the period during which the image display is performed and the period during which the sensing operation is performed, and generate control signals (DDC, GDC) for the image display and control signals (DDC, GDC) for sensing differently.

The gate control signal GDC includes a gate start pulse GSP, a gate shift clock GSC, a gate output enable signal GOE, and the like. The gate start pulse GSP is applied to a gate stage that generates a first scan signal to control the gate stage to generate the first scan signal. The gate shift clock GSC is a clock signal commonly input to the gate stages, and is a clock signal for shifting the gate start pulse GSP. The gate output enable signal GOE is a masking signal that controls the output of the gate stages.

The data control signal DDC includes a source start pulse SSP, a source sampling clock SSC, a source output enable signal SOE, and the like. The source start pulse SSP controls the data sampling start timing of the data driving circuit 12. The source sampling clock SSC is a clock signal that controls the sampling timings of data in respective source drive ICs on the basis of a rising or falling edge. The source output enable signal SOE controls the output timing of the data driving circuit 12.

The timing controller 11 calculates compensation parameters capable of compensating for a change in the electrical characteristics of the driving TFT based on the digital sensing values SD input from the data driving circuit 12, and may store the compensation parameter in a memory. The compensation parameters stored in the memory can be updated each time the sensing operation is performed, and thus the time-varying characteristics of the driving TFT can be easily compensated.

In the display driving, the timing controller 11 reads the compensation parameters from the memory, corrects the digital data of input image based on the compensation parameters, and supplies it to the data driving circuit 12.

The data driving circuit 12 may include one or more source drive ICs SDIC. The source drive IC SDIC may includes a plurality of digital-to-analog converters DAC connected to the data lines 14A and a sensing circuit connected to a plurality of sensing lines 14B. The sensing circuit may includes a plurality of sensing units SU connected to a sensing line 14B and an analog-to-digital converter ADC.

The source drive IC includes a receiving unit Rx and a de-serializer for separating received data to output the received data to a plurality of DACs, in order to receive data from the timing controller 11 via the two wire pairs EPI1 and EPI2. The source drive IC may further include a serializer for providing the output of the ADC as consecutive data and a transmission unit Tx, in order to transmit the sensing data sensed by the sensing circuit to the timing controller 11 via a second wire pair EPI2.

Each sensing unit may be connected in common to a plurality of pixels P arranged in one pixel line through a sensing line 14B as shown in FIG. 4. In FIG. 4, one unit pixel UPXL comprising four pixels P is shown as sharing one sensing line 14B, but is not limited thereto. The present disclosure can be applied to various modifications in which two or more pixels P are connected to one sensing unit via one sensing line 14B.

The DAC of the source drive IC converts input image data into data voltages for displaying in accordance with the data control signal DDC applied from the timing controller 11 at the time of display driving and supplies the data voltages to the data lines 14A. The data voltage for display is a voltage that varies depending on the gray level of the input image.

The DAC of the source drive IC generates data voltages for sensing in accordance with the data control signal DDC applied from the timing controller 11 at the time of the sensing driving and supplies the data voltages to the data lines 14A. The data voltages for sensing are capable of turning on the driving TFTs provided in the pixels P during the sensing driving. The data voltages for sensing may be generated with the same value for all the pixels P. Also, taking into account that the pixel characteristics are different for each color, the data voltages for sensing may be generated with different values for individual colors. For example, the data voltage for sensing may be generated with a first value for first pixels representing a first color, a second value for second pixels representing a second color and a third value for third pixels representing a third color.

The sensing unit supplies a reference voltage Vref to the sensing line 14B and senses and holds a sensing value (electrical characteristic value for the OLED or the driving TFT) inputted through the sensing line 14B and then feeds it to the ADC.

At the time of display driving, the source drive IC may receive the control data and the video data transmitted through both of the two wire pairs EPI1 and EPI2 using the receiving unit Rx, and distribute the video data to a plurality of DACs using the de-serializer.

At the sensing driving, the source drive IC may receive sensing commands and the video data for sensing (or data voltage information for sensing) through the first wiring pair EPI1 and/or the second wiring pair EPI2, supply the video data for sensing to the data line through the DAC, detect voltages indicating the driving characteristics of pixels by driving the sensing circuit based on the timing information included in the sensing commands, converting the digital data output from the ADC into consecutive data using the serializer, and supply the consecutive digital data to the timing controller 11 through the second wire pair EPI2 using the transmission unit Tx.

The gate driving circuit 13, at the time of the display driving, generates the gate pulses for displaying and sequentially supplies the gate pulses to the gate lines 15 connected to pixel lines based on the gate control signal GDC. The pixel lines are a set of horizontally adjacent pixels. The gate pulse swings between a gate high voltage VGH and a gate low voltage VGL. The gate high voltage VGH is set to a voltage higher than a threshold voltage of a TFT to turn the TFT on, and the gate low voltage VGL is lower than the threshold voltage of the TFT.

During the sensing driving, the gate driving circuit 13 generates the gate pulses for sensing and sequentially supplies the gate pulses to the gate lines 15 respectively connected to the pixel lines based on the gate control signal GDC. The gate pulses for sensing may have an on-pulse interval wider than the gate pulses for display. One or more on-pulse sections of the gate pulse for sensing may be included within one line sensing on-time. Here, the one line sensing on-time is a scan time taken to simultaneously sense the pixels P of one pixel line.

Figure 5:
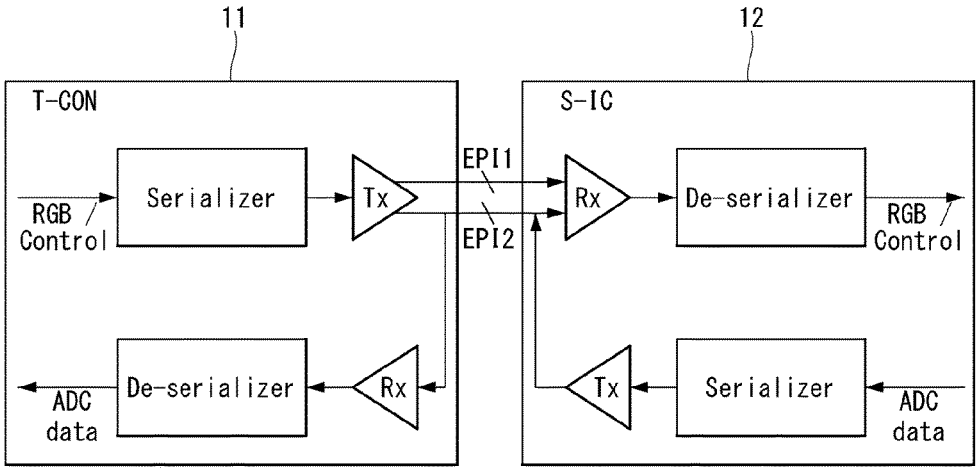
FIG. 5 illustrates wiring connections between a timing controller and a source drive IC, according to an embodiment of the present disclosure.
Figure 6A:
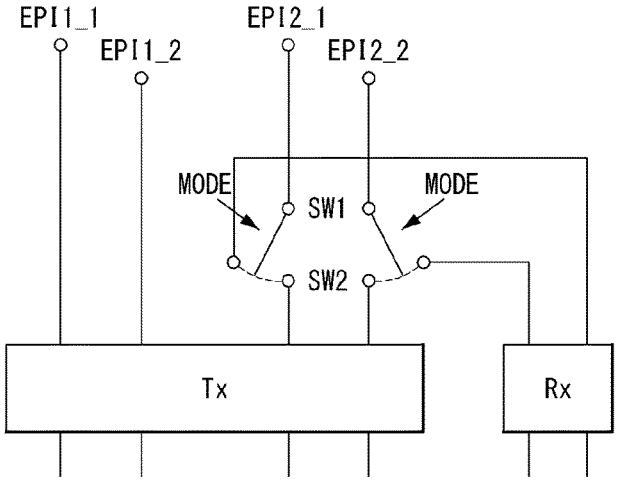
FIGS. 6A and 6B show switch connections for switching the operation mode of an EPI2 wiring pair between a transmission Tx mode and a receiving Rx mode in the timing controller and the source drive IC, respectively, according to an embodiment of the present disclosure.
Figure 6B:
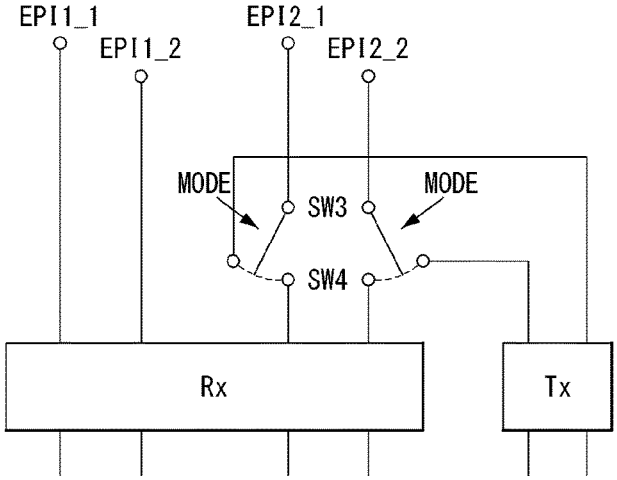

FIG. 5 illustrates wiring connections between a timing controller and a source drive IC according to an embodiment of the present disclosure, and FIGS. 6A and 6B show switch connections for switching the operation mode of an EPI2 wiring pair between a Tx mode and a Rx mode in the timing controller and the source drive IC, respectively.

The timing controller 11 includes the serializer Serializer for converting video data and control data into consecutive data and the transmission unit Tx for transmitting data through an EPI interface, as the elements for transmitting data to the source drive IC 12. And, the source driver IC 12 includes the receiving unit Rx for receiving data through the EPI interface and the de-serializer De-serializer for separating the received control data and video data and distributing the video data to a plurality of DACs for driving pixels.

The source drive IC 12 includes the serializer Serializer for converting the sensing data sensed in the sensing circuit into consecutive data and the transmission unit Tx for transmitting the converted sensing data through a second EPI wire pair, as elements for transmitting the sensing data reflecting the driving characteristics of pixels to the timing controller 11. The timing controller 11 includes the receiving unit Rx for receiving the sensing data through the second EPI wire pair and the de-serializer De-serializer for separating the received data to a desired form.

In the present disclosure, among two EPI wiring pairs EPI1 and EPI2, which is a panel internal interface for transmitting video data, for example, a second EPI wiring pair EPI2 can be used for bidirectional communication according to an operation mode. The second EPI wiring pair EPI2 may operate in a reception mode (Rx mode) on the basis of the source drive IC in the display driving and in a transmission mode (Tx mode) on the basis of the source drive IC in the sensing driving.

To this end, the timing controller 11 is provided with a first switch pair SW1 and SW2 to selectively connect the second EPI wire pair EPI2 between the transmission unit Tx and the receiving unit Rx according to a mode signal MODE indicating one of the display driving and the sensing driving. The mode signal MODE may be provided by the serializer equipped in the timing controller 11. And, the source drive IC 12 is provided with a second switch pair SW3 and SW4 to selectively connect the second EPI wire pair EPI2 between the transmission unit Tx and the receiving unit Rx according to the mode signal MODE indicating one of the display driving and the sensing driving. At this time, in the source drive IC 12, the mode signal MODE is included in the control data packet provided through the first EPI wiring pair EPI1, and is extracted by the de-serializer of the source drive IC 12 to be supplied to the second switch pair SW3 and SW4.

The mode signal MODE controlling the operations of the first and second switch pairs may be the information indicating whether a driving mode is the display driving or the sensing driving or the information indicating the data communication direction of the second EPI wire pair EPI2, and be generated and provided by the serializer included in the timing controller 11.

Figure 7:
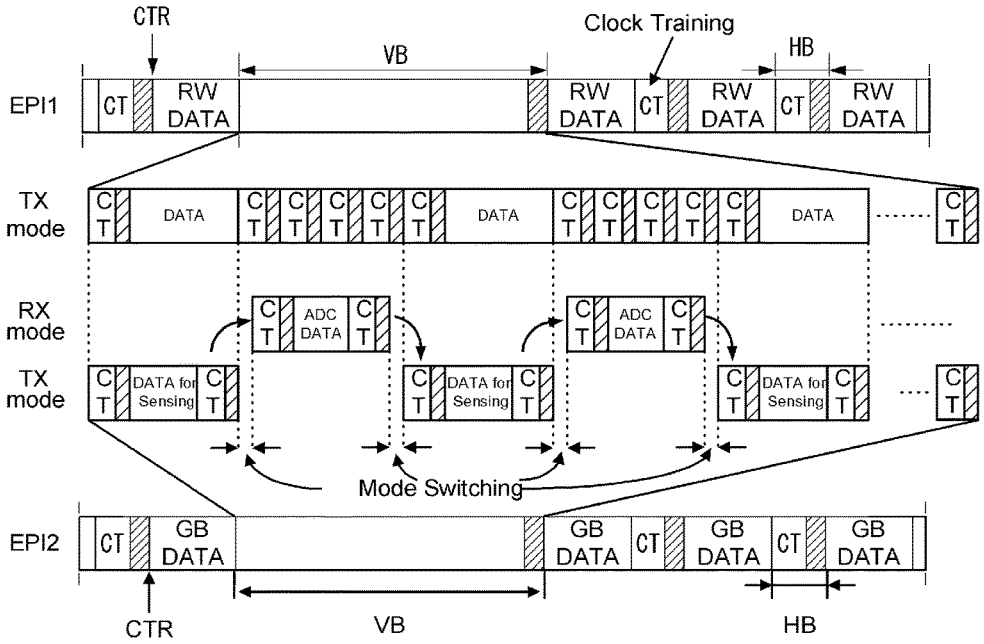
FIG. 7 illustrates a signal format of an EPI interface protocol for implementing the transmission of sensing data according to an embodiment of the present disclosure.

FIG. 7 illustrates a signal format of an EPI interface protocol for implementing the transmission of sensing data according to an embodiment of the present disclosure.

First, the EPI interface will be described.

The EPI interface protocol satisfies the following (1) to (3).

(1) The transmitting end of the timing controller and the receiving end of the source drive ICs are connected through a data wire pair in a point-to-point manner.

(2) No separate clock wiring pair is connected between the timing controller and the source drive ICs. The timing controller transmits control data and the pixel data of input image (or video data) together with a clock signal to the source drive ICs through the data wire pair.

(3) Each of the source drive ICs is equipped with a clock recovery circuit for CDR (Clock and Data Recovery). The timing controller transmits a clock training pattern or a preamble signal to the source drive IC so that the output phase and frequency of the clock recovery circuit can be fixed. The clock recovery circuit built in each source drive IC generates an internal clock when the clock training pattern signal or preamble signal are input through the data wire pair.

In the EPI interface protocol, the timing controller transmits a preamble signal to the source drive IC before transmitting the control data and the video data of the input image. The clock recovery circuit in the source drive IC performs a clock training operation CT based on the preamble signal to stably fix the phase and frequency of a recovered internal clock. The data link through which the video data of the input image is transmitted between the source drive IC and the timing controller is established after the phase and frequency of the internal clock are fixed stably. The timing controller starts sending a data packet containing the control data and the video data to the source drive IC after a lock signal is received from a last source drive IC.

When the output phase and frequency of the clock recovery circuit built in any one of the source drive ICs are unlocked, the source drive IC inverts a lock signal to be transmitted to the timing controller to a low logic level. The last source drive IC transfers the lock signal inverted to the low logic level to the timing controller. The timing controller retransmits the preamble signal to the source drive ICs so that the clock trainings of the source drive ICs resume when the lock signal is inverted to the low logic level. To this end, as shown in FIG. 1, the timing controller and each source drive IC are sequentially connected in a cascade manner through a lock signal line to transmit the lock signal Lock. A source drive IC transmits the lock signal of the low logic level to a next source drive IC connected to the lock signal line regardless of the lock operation of its clock recovery circuit, when the lock signal of the low logic level is sent from a previous source drive IC connected to the lock signal line.

As shown in FIG. 7, the timing controller 11 serially transmits the clock training pattern or preamble signal CT, a control data packet CTR, and a video data packet DATA through the EPI wire pair according to the EPI interface protocol. The control data packet CTR may be divided into a plurality of sub control data packets CTR1-CTR4. The timing controller 11 may transmit the video data RW DATA of red R and white W through the first EPI wire pair EPI1 in a serial manner, and transmit the video data GB DATA of green G and blue B through the second EPI wire pair EPI2 in the serial manner In FIG. 7, VB is a vertical blank period, and HB is a horizontal blank period. The vertical blank period VB is the blank period between N-th frame and (N+1)-th frame. The horizontal blank period HB is the blank period between N-th line data and (N+1)-th line data. The N-th line data corresponds to the data to be written to the pixels disposed in an N-th horizontal line of the display panel 10. The (N+1)-th line data corresponds to the data to be written to the pixels disposed in a (N+1)-th horizontal line of the display panel 10.

The data received through the EPI wire pairs EPI1 and EPI2 include clocks. The control data packet sent through the EPI wire pairs EPI1 and EPI2 may include source control data, an option signal, etc. for controlling the operation timing of the source drive IC. The option signal may include various option signals for the gate driving circuit and the source drive IC, such as the gate start pulse GSP controlling the shift register start timing of the gate driving circuit, the skew option signal of the source drive IC, a power option signal, etc. The gate control signal for controlling the driving timing of the gate driving circuit may be transmitted through a separate wire to the gate driving circuit.

The timing controller 11 processes the data of input image provided by a source (or a host) to comply with the EPI interface protocol and sends the processed data to the source drive ICs 12. One horizontal period 1HT is a time duration required to write data to all pixels arranged in one horizontal line. One horizontal period 1HT includes the transmission time of the control data packet CTR and the video data packets of one horizontal line which are serially transmitted to the source drive ICs 12 through the EPI wire pairs EPI1 and EPI2.

At the time of display driving for displaying image in a panel, the communications of the first and second EPI wire pairs EPI1 and EPI2 are performed in a direction (hereinafter referred as a first direction) in which the control data and video data are provided from the timing controller 11 to the source drive ICs 12. So, the transmission unit of the timing controller 11 operates and the receiving units of the source drive ICs operate.

At the time of the display driving, the timing controller 11 may transmit, for example RW video data and GB video data through the first EPI wire pair EPI1 and the second EPI wire pair EPI2 during 1 horizontal period 1HT, respectively. The timing controller 11 may transmit the clock training pattern and the control data packet during the vertical blank period VB and the horizontal blank period HB and transmit the video data packet during 1 horizontal period 1HT except for the horizontal blank period HB.

At the time of the sensing driving for sensing the driving characteristics of pixels, the communication of the first EPI wire pair EPI1 is performed in a direction in which the control data related to a sensing command and the video data for sensing are provided from the timing controller 11 to the source drive ICs 12, and the communication of the second EPI wire pair EPI2 may be performed in a direction (hereinafter referred as a second direction) in which sensing data is provided from the source drive ICs 12 to the timing controller 11.

Alternatively, at the time of the sensing driving, the data communication through the second EPI wire pair EPI2 may switch between the first direction and the second direction. The data related to the sensing command may be transmitted in the first direction through the second EPI wire pair EPI2 and the sensing data may be transmitted in the second direction through the second EPI wire pair EPI2.

The data related to the sensing command may include the information indicating the pixel line to sense its driving characteristics, the pixel color information to measure its driving characteristics, the data information for sensing to be provided to a data line for applying the data to pixels to sense driving characteristics, the sensing timing signal for controlling the operation of the sensing circuit, etc, and may be encoded in the control data packet CTR and/or the data packets DATA. The sensing timing signal may include a plurality of signals for individually controlling elements. Instead of encoding the information indicating the pixel line to sense its driving characteristics and the data information for sensing to the control data packet CTR, the data information for sensing may be written in the data packet as the data to be written to the pixel line to sense its driving characteristics, and the data for displaying black may be written in the data packet as the data to be written to other pixel lines not to sense any driving characteristics.

As described above, the sensing driving may be performed during a power-on sequence period, a power-off sequence period, or a vertical blank period VB. In the power-on sequence period and the power-off sequence period, the data related to the sensing command may be transmitted through the first EPI wire pair EPI1 in the first direction and the sensing data may be transmitted through the second EPI wire pair EPI2 in the second direction. Or even in the power-on sequence period and the power-off sequence period, the data communication through the second EPI wire pair EPI2 may alternate between the first direction and the second direction.

FIG. 7 displays the data communication through the first and second EPI wire pairs EPI1 and EPI2 in an enlarged manner when the sensing driving is performed during VB. During VB, the first directional communication and the second directional communication through the second EPI wiring pair EPI2 may be alternately performed to exchange the data related the sensing command and the sensing data. That is, during VB, through the second EPI wiring pair EPI2, the data related to the sensing command may be transmitted in the first direction and the sensing data may be transmitted in the second direction.

During VB, through the first EPI wire pair EPI1, in the first direction, the clock training pattern CT and the control data packet CTR may be repeatedly transmitted or the clock training pattern CT, the control data packet CTR and the data packet DATA may be sequentially and repeatedly transmitted.

When the sensing driving is performed during VB, the communication through the second EPI wire pair EPI2 may alternate between the first direction and the second direction. Through the second EPI wire pair EPI2, the data packet (DATA for Sensing) including the clock training pattern CT, the control data packet CTR and the data related to the sensing command is transmitted in the first direction, then a communication direction is switched (Mode Switching), and the data packet including the clock training pattern CT, the control data packet CTR and the sensing data is transmitted in the second direction. When the sensing driving is performed during VB, the switching between the first directional communication and the second directional communication may be repeated two times or more.

When the sensing driving is performed during VB, the control data packet transmitted in the first direction through the second EPI wire pair EPI2 may include the information indicating the switching the data communication direction to the second direction (or the terminal of the transmission of the data related to the sensing command), and the control data packet transmitted in the second direction through the second EPI wire pair EPI2 may include the information indicating the switching the data communication direction to the first direction (or the terminal of the transmission of the sensing data), Or, the information indicating the switching the data communication direction of the second EPI wire pair EPI2 may be included in the control data packet to be transmitted through the first EPI wire pair EPI1 and then transmitted to the source drive ICs 12, and the data communication direction of the second EPI wire pair EPI2 may be switched based on the information.

In FIG. 7 illustrates the example in which the communication of the second EPI wire pair EPI2 alternates between the first direction and the second direction during VB, but during VB only the second directional communication may be performed through the second EPI wire pair EPI2. At a beginning time of VB, a redirection occurs from the first direction communication to the second direction communication and a redirection from the second direction communication to the first direction communication occurs at a later time of VB. In this case, the data related to the sensing command may be transmitted through the first EPI wire pair EPI1.

By performing the sensing driving and transmitting the sensing data through the second EPI wiring pair EPI2 with a higher data rate during VB, it becomes possible to detect the driving characteristics of more pixels during VB, and to compensate the driving characteristics of more pixels in real time.

Figure 8:
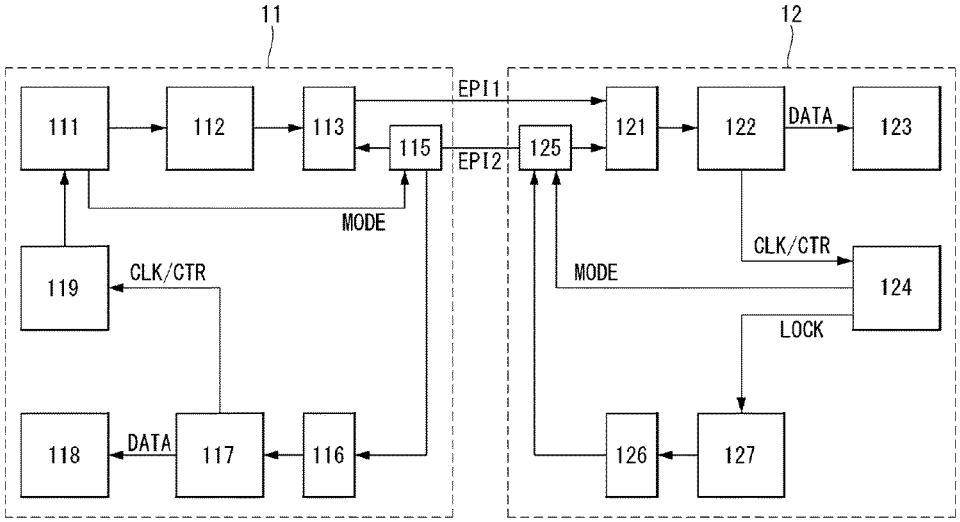
FIG. 8 illustrates a block configuration for processing data in an interface between the timing controller and the source drive IC according to an embodiment of the present disclosure.

FIG. 8 illustrates a block configuration for processing data in an interface between the timing controller and the source drive IC according to an embodiment of the present disclosure.

The time controller 11 may comprise a scheduler 111, a first data generator 112, a first transmission unit 113, a first switch pair 115, a first receiving unit 116, a first data separator 117, a sensing data recovering unit 118 and a first control data recovering unit 119. The scheduler 111 and the first data generator 112 may be integrated into a first serializer, and the first data separator 117, the sensing data recovering unit 118 and the first control data recovering unit 119 may be integrated into a first de-serializer.

The scheduler 111 generates the interrupt signal indicating the sensing driving for sensing the driving characteristics of pixels or the display driving for displaying input image and provides the interrupt signal to the first data generator 112. Also, the scheduler 111 generates the mode signal MODE indicating the data communication direction of the second EPI wire pair EPI2 and transmits the mode signal MODE to the first data generator 112 and the first switch pair 115. The sensing circuit of the display panel 10 senses the driving characteristics of pixels according to the sensing command received from the timing controller 11 at the time of the sensing driving and the driving circuits in the display panel 10 writes the data of input image to pixels at the time of the display driving.

The first data generator 112 generates the clock training pattern CT, the control data packet CTR and the data packet DATA to comply with the EPI interface protocol. That is, the first data generator 112 encodes the video data of input image into the data packet in response to the interrupt signal in the display driving and encodes a display driving/sensing driving signal, a timing signal, etc. indicated by the interrupt signal into the control data packet.

At the time of the sensing driving, the data packet DATA may include preset data irrespective of the data of input image, and the control data packet CTR may include sensing commands such as pixel line information for sensing driving characteristics, pixel color information for measuring driving characteristic, timing information of the sensing circuit, and the like.

The first data generator 112 separates the video data of the input image based on colors, for example separates RW and GB, to generate EPI data and transmits the EPI data to the first and second EPI wire pairs EPI1 and EPI2 at the time of the display driving. The first data generator 112, at the time of the sensing driving, may generate the sensing command and the video data for sensing to be the EPI data to be transmitted through the first EPI wire pair EPI1 or the EPI data to be transmitted through the second EPI wire pair EPI2.

The first data generator 112 may generates the mode signal MODE indicating the data communication direction of the second EPI wire pair EPI2 to be the EPI data to be transmitted through the first or second EPI wire pair EPI1 or EPI2. The mode signal MODE may be set as a value indicating the first direction at the time of the display driving and as a value indicating the second direction at the time of the sensing driving. Alternatively, at the time of the sensing driving, in case that the sensing command is transmitted through the second EPI wire pair EPI2, since the data communication of the second EPI wire pair EPI2 for the transmission of the sensing command data and the sensing data alternates between the first direction and the second direction, the mode signal MODE may be repeatedly changed to be a value indicating the first direction or a value indicating the second direction.

The first transmission unit 113 converts clock-embedded data into the data for a differential signal pair defined in the EPI interface protocol and transmits the converted data to the source drive ICs 12 through the first and second EPI wire pairs EPI1 and EPI2. The first transmission unit 113 may transmit the data through the first and second EPI wire pairs EPI1 and EPI2 or through the first EPI wire pair EPI1 based on the interrupt signal and/or the mode signal MODE.

The first switch pair 115 may selectively connect the second EPI wire pair EPI2 to the first transmission unit 113 or the first receiving unit 116 according to the mode signal MODE provided by the scheduler 111.

The first receiving unit 116 receives the sensing data from the source drive ICs through the second EPI wire pair EPI2 at the time of the sensing driving.

The first data separator 117 may recover a clock from the signal received by the first receiving unit 116 and generate a data sampling clock using the clock recovery circuit, and separate the control data packet CTR and the data packets DATA based on the generated clock. And, the first data separator 117 may generate and output the lock information indicating that the clock is locked when the clock is recovered (or the information indicating the completion of the data communication link in the second direction through the second EPI wire pair EPI2).

The sensing data recovering unit 118 samples the data packets DATA using the data sampling clock recovered by the first data separator 117 and recovers the sensing data ADC DATA.

The first control data recovering unit 119 recovers the control data using the data sampling clock recovered by the first data separator 117. The control data provided from the source drive ICs 12 may include the end information indicating the end of the second directional communication through the second EPI wire pair EPI2 (or the information indicating to switch the data communication direction to the first direction or the information indicating the end of the sensing data).

The scheduler 111 may change the mode signal MODE to indicate that the communication direction of the second EPI wire pair EPI2 is the first direction, based on the end information provided by the first control data recovering unit 119.

The first data generator 112 may encode the lock information provided by the first data separator 117 into the control data packet and the control data packet may be provided to the source drive ICs 12 through the first EPI wire pair EPI1 by the first transmission unit 113.

The source drive IC 12 may comprise a second receiving unit 121, a second data separator 122, a video data recovering unit 123, a second control data recovering unit 124, a second switch pair 125, a second transmission unit 126 and the second data generator 127. The second data separator 122, the video data recovering unit 123 and the second control data recovering unit 124 may be integrated into a second de-serializer, and the second data generator 127 may be referred as a second serializer.

The second receiving unit 121 may receive the video data of input image and the control data from the timing controller 11 through the first and second EPI wire pairs EPI1 and EPI2 at the time of display driving, and may receive data through both of the first and second EPI wire pairs EPI1 and EPI2 or through only the first EPI wire pair EPI1 at the time of the sensing driving.

The second data separator 122 may recover a clock from the signal received through each EPI wire pair by the second receiving unit 121 and generate a data sampling clock using a clock recovering circuit, and separate the control data packet CTR and the data packets DATA based on the generated clock.

At the time of display driving, the second data separator 122 may generate a first lock signal indicating the recovery of the clock (or a signal indicating that a data communication link is completed in the first direction through the first EPI wire pair EPI1) when the clock is recovered from the signal received through the first EPI wiring pair EPI1, generate a second lock signal indicating the recovery of the clock (or a signal indicating that a data communication link is completed in the first direction through the second EPI wire pair EPI2) when the clock is recovered from the signal received through the second EPI wiring pair EPI2, perform the AND logic operation for the first lock signal and the second lock signal to generate a third lock signal and transmit the third lock signal to the timing controller 11 through the lock signal line.

When the third lock signal of a high logic level is sent from the source drive IC 12 through the lock signal line, the first data generator 112 may terminate the transmission of the clock training pattern CT and generate the control data packet CTR and the data packets DATA to transmit via the first transmission unit 113.

The video data recovering unit 123 samples and recovers the video data received from the second data separator 122 using the data sampling clock and converts the recovered data intro parallel data. The parallel data is sent to the DAC and converted into data voltages to be output to the data lines in the display panel 10.

The second control data recovering unit 124 recovers the control data including timing signals or sensing commands to generate the control signal for controlling the display operation or the sensing operation. The second control data recovering unit 124 may extract the mode signal MODE indicating the communication direction of the second EPI wire pair EPI2 from the control data packet CTR transmitted through the first EPI wire pair EPI1 and/or the second EPI wire pair EPI2 and provide it to the second switch pair 125 and the second data separator 122.

And the second control data recovering unit 124 may extract and output the lock information from the control data packet CTR transmitted through the first EPI wire pair EPI1 at the time of the sensing driving.

Since the second lock signal of a high logic level cannot be generated when the data communication through the second EPI wire pair EPI2 is performed in the second direction, the second data separator 122 may perform the OR logic operation of the mode signal MODE provided by the second control data recovering unit 124 with the second lock signal and perform the AND logic operation of the result value of the OR operation with the first lock signal to transmit through the lock signal line, so that the timing controller 11 and the source drive ICs 12 can successively perform the data communication through the EPI interface.

The second switch pair 125 may selectively connect the second EPI wire pair EPI2 to the second receiving unit 121 or the second transmission unit 126 according to the mode signal MODE provided by the second control data recovering unit 124.

The second data generator 127 generates the sensing data ADC DATA sensed and digitally converted by the sensing circuit to be an EPI data format at the time of the sensing driving. The second data generator 127 may generate the clock training pattern CT and transmit it to the timing controller 11 through the second EPI wire pair EPI2. The second data generator 127 may generate the data packet including the control data packet CTR and the sensing data ADC DATA when the second control data recovering unit 124 provides lock information (information indicating the completion of the data communication link in the second direction through the second EPI wire pair EPI2).

And, the second data generator 127 may generate the control data packet including the information indicating the end of sensing in order for the scheduler 111 in the timing controller 11 to change the data communication direction of the second EPI wire pair EPI2, when the transmission of the sensing data is terminated after the completion of the sensing operation.

The second transmission unit 126 transmits the EPI data generated by the second data generator 127 to the timing controller 11 through the second EPI wire pair EPI2 at the time of the sensing driving.

By providing the lock information indicating the completion of the data communication link in the second direction through the second EPI wire pair EPI2 by using the control data packet of the first EPI wire pair EPI1 through which the communication link in the first direction is maintained, the lock signal required to communicate data through the second EPI wire pair EPI2 in the second direction can be transferred without a separate lock signal line.

Meanwhile, as a result of experiments, when switches are connected to an EPI wire pair, the maximum data transmission rate drops from 1.5 GHz to 1.4 GHz, but is much higher than the maximum data transmission speed of B-LVDS, so there is no problem with an implementation.

It will be apparent to those skilled in the art that various modifications and variations can be made in the present disclosure without departing from the spirit or scope of the disclosure. Therefore, the technical scope of the present disclosure should not be limited to the contents described in the detailed description of the specification, but should be defined by the claims.

What is claimed is:

1. A display device, comprising:

a display panel equipped with a plurality of pixels;

a source drive integrated circuit (IC) configured to provide data voltages to the pixels, convert signals indicating driving characteristics of the pixels into sensing data and output the sensing data; and a timing controller configured to transmit a control data packet and a video data packet to the source drive IC through first and second wire pairs and receive the sensing data from the source drive IC through the second wire pair, wherein the timing controller is configured to load lock information into the control data packet and provide the control data packet to the source drive IC through the first wire pair, when receiving data from the source drive IC through the second wire pair, the lock information that is loaded into the control data packet indicating whether a clock extracted from a signal provided from the source drive IC through the second wire pair matches a phase and frequency of an internal clock of the source drive IC.

2. The display device of claim 1, wherein the timing controller is configured to transmit, through the first wire pair or the second wire pair, data related to a sensing command indicating to sense the driving characteristics, and receive the sensing data through the second wire pair.

3. The display device of claim 2, wherein the source drive IC is configured to sense the driving characteristics during a power-on sequence, a power-off sequence or a vertical blank period, and transmit the sensing data to the timing controller through the second wire pair.

4. The display device of claim 3, wherein the timing controller is configured to operate the second wire pair only in a reception mode or switch an operation mode of the second wire pair between a transmission mode and the reception mode during a power-on sequence, a power-off sequence or a vertical blank period.

5. The display device of claim 2, wherein the data related to the sensing command includes pixel line information for sensing the driving characteristics, pixel color information for sensing the driving characteristics and data for sensing to drive a corresponding pixel color.

6. The display device of claim 1, wherein the timing controller comprises:

a first transmission unit for sending the control data packet, the video data packet and signals including a clock to the source drive IC;

a first receiving unit for receiving the signal from the source drive IC through the second wire pair at a time of a sensing driving of sensing the driving characteristics;

a first switch pair for selectively connecting the second wire pair to one of the first transmission unit and the first receiving unit according to mode information indicating a communication direction of the second wire pair;

a first serializer for generating the mode information and generating the video data packet including video data of input image and the control data packet including the mode information and the lock information; and a first de-serializer for recovering the clock from the signal received by the first receiving unit, generating the lock information indicating whether the clock is locked or not, sending the lock information to the first serializer and recovering the sensing data, at the time of the sensing driving.

7. The display device of claim 6, wherein the source drive IC comprises:

a second receiving unit for receiving a signal through the first and the second wire pairs;

a second transmission unit for sending a signal including sensing data packet and a clock through the second wire pair at the time of the sensing driving;

a second switch pair for selectively connecting the second wire pair to one of the second receiving unit and the second transmission unit according to the mode information;

a second de-serializer for recovering a clock from the signal received by the second receiving unit, separating control data and video data based on the recovered clock, and extracting the mode information and the lock information from the control data; and a second serializer for encoding received sensing data into the sensing data packet to output to the second transmission unit at the time of the sensing driving, wherein the second transmission unit transmits a signal including the clock and then transmits a signal including the sensing data packet according to the lock information.

8. The display device of claim 7, wherein the second de-serializer generates a first lock signal and a second lock signal and generates a third lock signal based on the first and second lock signals at a time of a display driving for displaying the input image on the display panel, and generates the third lock signal based on the first lock signal and the mode information at the time of the sensing driving, the first lock signal indicating whether a clock extracted from the signal received by the second receiving unit through the first wire pair is locked or not and the second lock signal indicating whether a clock extracted from the signal received by the second receiving unit through the second wire pair is locked or not, and wherein the third lock signal is provided to the timing controller through a lock signal line.

9. The display device of claim 8, wherein the second de-serializer generates the third lock signal by performing an AND logic operation of the first lock signal and a result value obtained by an OR logic operation of the second lock signal and the mode information.

10. The display device of claim 7, wherein the second transmission unit transmits the sensing data packet which is generated by the second de-serializer and includes sensing end information indicating an end of the sensing driving through the second wire pair, wherein the first de-serializer extracts the sensing end information from the sensing data packet and outputs the extracted sensing end information to the first serializer, and wherein the first serializer changes a value of the mode information bases on the sensing end information.

* * * * *